US006773270B2

(12) United States Patent
Ushio et al.

(10) Patent No.: US 6,773,270 B2
(45) Date of Patent: Aug. 10, 2004

(54) CONNECTOR FOR CARTRIDGE OF ELECTRONIC PARTS

(75) Inventors: Kohei Ushio, Osaka (JP); Yutaka Ushiro, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/829,935

(22) Filed: Apr. 11, 2001

(65) Prior Publication Data

US 2002/0025725 A1 Feb. 28, 2002

(30) Foreign Application Priority Data

Apr. 13, 2000 (JP) ..... 2000-112318

(51) Int. Cl.[7] ..... H01R 12/00
(52) U.S. Cl. ..... 439/76.1
(58) Field of Search ..... 439/76.1, 701, 439/707, 713, 351, 529

(56) References Cited

U.S. PATENT DOCUMENTS 5,563,770 A * 10/1996 Bethurum ..... 361/737
6,371,793 B1 4/2002 Doorhy et al.

FOREIGN PATENT DOCUMENTS

JP 2000-67979 3/2000

* cited by examiner

*Primary Examiner*—Renee Luebke
*Assistant Examiner*—Ann McCamey
(74) *Attorney, Agent, or Firm*—Oblon, Spivak, McClelland, Maier & Neustadt, P.C.

(57) ABSTRACT

A unit is composed in such a manner that the circuit board is fixed along the back face of the plug housing into which the contacts are incorporated. The plug type connector is assembled in such a manner that the cover housing is slid in parallel with the surface of the circuit board and incorporated into the unit. At this time, the edge section of the circuit board and the edge section of the plug housing, which is set along the circuit board, are introduced into the guide groove of the cover housing.

21 Claims, 7 Drawing Sheets

CONNECTOR FOR CARTRIDGE OF ELECTRONIC PARTS

BACKGROUND OF THE INVENTION

1. Field of the Invention

The present invention relates to a connector for a cartridge of electronic parts such as a toner cartridge, for example, a toner cartridge incorporated into a copier, facsimile terminal equipment or printer.

2. Description of the Related Art

In general, an image forming apparatus is provided with a function of letting a user of the image forming apparatus know that the renewal time of a toner cartridge has come. Commonly, when the toner cartridge is attached to the image forming apparatus, a counter to count the number of times of image formation is reset. The number of times of image formation is integrated by the counter on the image forming apparatus side. When this number of times of image formation has reached a predetermined value, a command is displayed on an operation display so that the toner cartridge can be replaced with a new one.

In the image forming apparatus, a quantity of toner supplied to a developing device is controlled according to the concentration of toner accommodated in a toner cartridge, so that an image of high quality can be formed on a sheet of paper at all times. Therefore, it is necessary that a quantity of residual toner in the toner cartridge is accurately grasped. This quantity of residual toner is calculated by giving consideration to the number of times of image formation, which is counted by the above counter, and the size of a sheet of paper.

In this connection, in some cases, a toner cartridge, the life of which has not been fulfilled yet, is once detached from an image forming apparatus for the purpose of maintenance and then attached to the image forming apparatus again. In this case, since the counter to count the number of times of image formation is reset, it is impossible to accurately judge the life of the toner cartridge and the quantity of residual toner.

Recently, the market is infested with imitation articles made by the third parties. When these imitation articles are used, toner of low quality is supplied to the image forming apparatus. As a result, it is impossible for the image forming apparatus to exhibit the normal performance, and further the image forming apparatus might become out of order.

Therefore, the present inventors have devised that a memory to store various information is housed in the connector on the toner cartridge side. However, in this case, the following problems may be encountered. In the case of a commonly used connector housing of one piece structure, it is very difficult to arrange a circuit board including a memory in the housing, and further it is very difficult to assemble the connector.

SUMMARY OF THE INVENTION

The present invention has been accomplished in view of the above circumstances. It is an object of the present invention to provide a connector for a cartridge of electronic parts such as a toner cartridge which can be easily assembled.

In order to accomplish the above object, a first aspect of the invention provides a connector for a cartridge of electronic parts, which is a plug type connector fixed to a side plate of the cartridge of electronic parts,including: a plug housing having a back face opposing to the side plate of the cartridge of electronic parts; a cover housing combined with the plug housing; and a circuit board held by both the housings.

If the housing is composed of one piece, the structure in which the circuit board is laid out in the housing is restricted. However, according to the present structure, the housing is composed of two pieces. Therefore, the freedom of layout of the circuit board is enhanced, and the assembling can be easily carried out. When the number of times of image formation and the information about a quantity of residual toner are stored in the memory mounted on the circuit board housed in the connector, even if the cartridge of electronic parts is detached before the life of the cartridge is fulfilled and the cartridge of electronic parts is attached again, it is possible to accurately grasp the life of the cartridge of electronic parts and the quantity of residual toner. Further, when ID number is stored in the memory, it is possible to distinguish an imitation article from a true article. Therefore, it is possible to avoid using the imitation article. In this connection, the cartridge of electronic parts may be a single body. Alternatively, the cartridge of electronic parts may be composed of a unit in which other components of the image forming apparatus are integrated.

A second aspect of the invention provides a connector for a cartridge of electronic parts according to the first aspect of the invention, wherein the plug housing and the cover housing are combined with each other being relatively slid in a direction parallel with a surface of the circuit board. In this structure, the components can be easily assembled by a sliding assembling motion.

A third aspect of the invention provides a connector for a cartridge of electronic parts according to the second aspect of the invention, wherein the cover housing includes guide grooves to guide a sliding motion of the plug housing, and edge sections of the circuit board and edge sections of the plug housing are slid in the guide grooves. In this structure, the components can be easily assembled by a sliding assembling motion. Further, since edge sections of the circuit board and the plug housing are inserted into the guide grooves, the mechanical strength of combination of both the housings is high, and both the housings are so tightly combined with each other that the intrusion of toner into the housing can be prevented.

The invention described as a fourth aspect of the invention provides a connector for a cartridge of electronic parts according to the first aspect of the invention, wherein the circuit board is connected with the plug housing in such a manner that the circuit board covers an open portion of the plug housing, and a closed cross-section is formed by the circuit board and the plug housing. In this structure, the circuit board functions as a wall section of the plug housing. Therefore, the structural strength can be ensured.

The invention described as a fifth aspect of the invention provides a connector for a cartridge of electronic parts according to one of the first to fourth aspect of the invention, wherein a unit including the plug housing, circuit board and contacts is incorporated into the cover housing. When the components are integrated into a unit, the assembling can be easily carried out.

The invention described as a sixth aspect of the invention provides a connector for a cartridge of electronic parts according to the fifth aspect of the invention, wherein a forward end of a holding member to hold the circuit board and an exposed end portion of a lead penetrating the circuit board are located on the substantially same face as the back face of the plug housing, and they are located at the most backward position of the unit. According to the present structure, it is possible to conduct automatic mounting in which the leads of contacts and others can be automatically soldered to the circuit board in a dip tank.

The invention described as a seventh aspect of the invention provides a connector for a cartridge of electronic parts according to the sixth aspect of the invention, wherein the cover housing is provided with a protruding section for attaching to the cartridge of electronic parts. In this structure, the protruding portion which protrudes backward is arranged on the cover housing side. Due to the foregoing, the automatic mounting can be substantially realized when the back of the unit to which the circuit board is attached is made flat.

The invention described as an eighth aspect of the invention provides a connector for a cartridge of electronic parts according to one of the first to seventh aspect of the invention, wherein a lock section for locking both the plug housing and the cover housing, which are combined with each other, is arranged in a space surrounded by the plug housing and the cover housing. In this structure, what is called an inner lock structure is adopted. Therefore, when both housings are once combined with each other, they are not disconnected from each other even if a shock is given to them.

DETAILED DESCRIPTION OF THE PREFERRED EMBODIMENTS

Referring to the appended drawings, a preferred embodiment of the present invention will be explained below.

Figure 1:
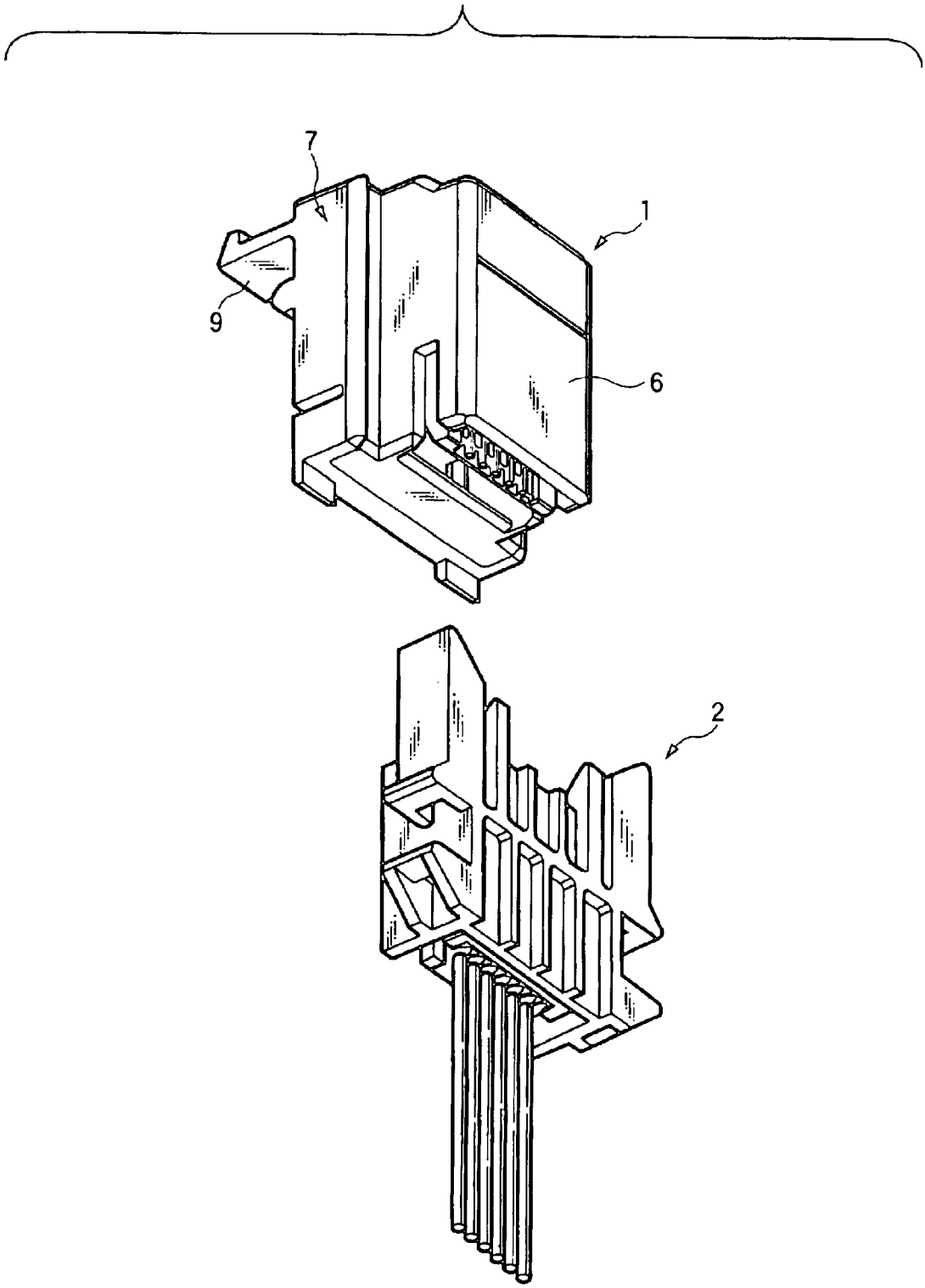
FIG. 1 is an exploded perspective view of a plug type connector and a receptacle type connector which form a pair of connectors as an embodiment of the present invention.
Figure 2:
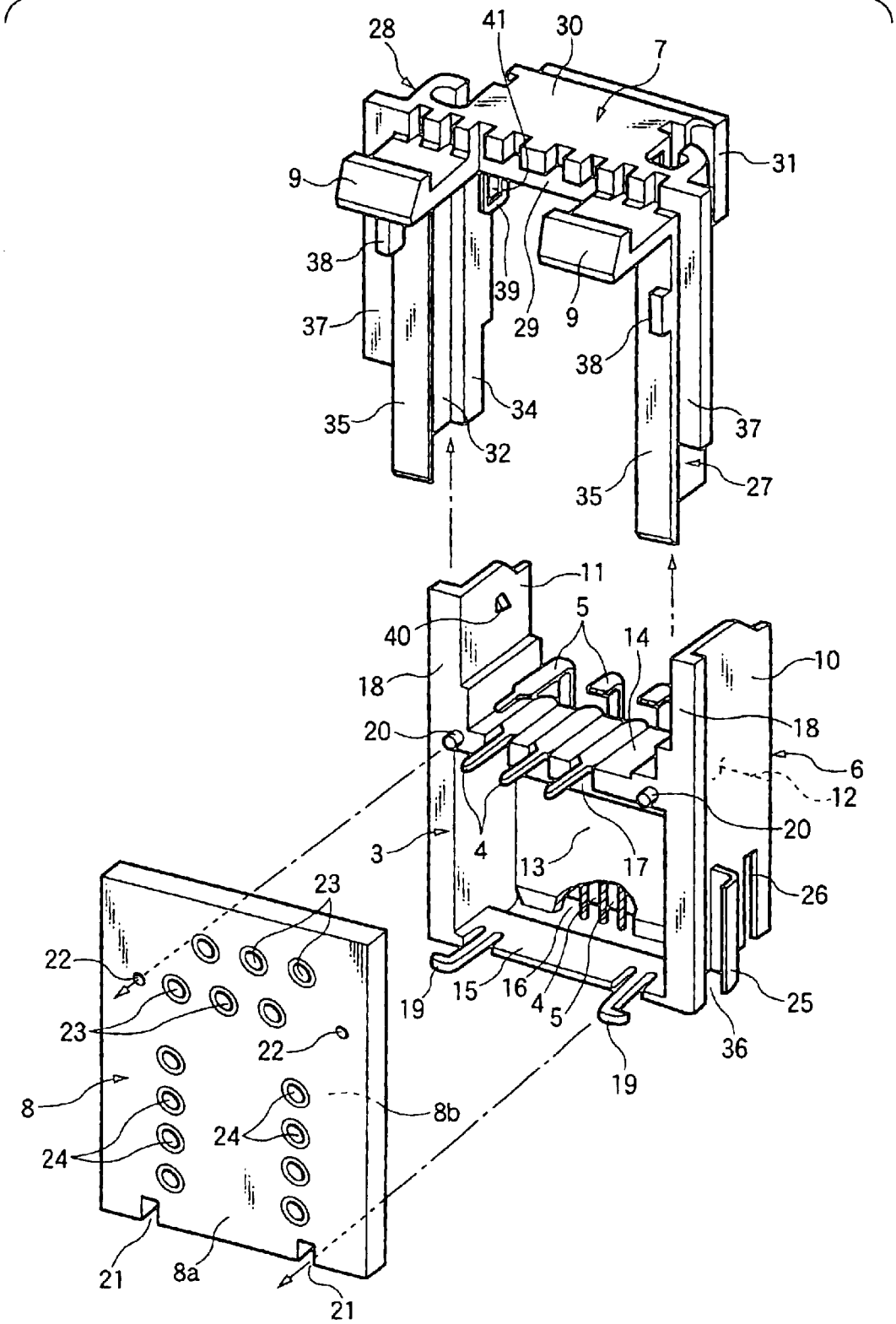
FIG. 2 is an exploded perspective view of the plug type connector, wherein the view is taken from the back side.
Figure 3:
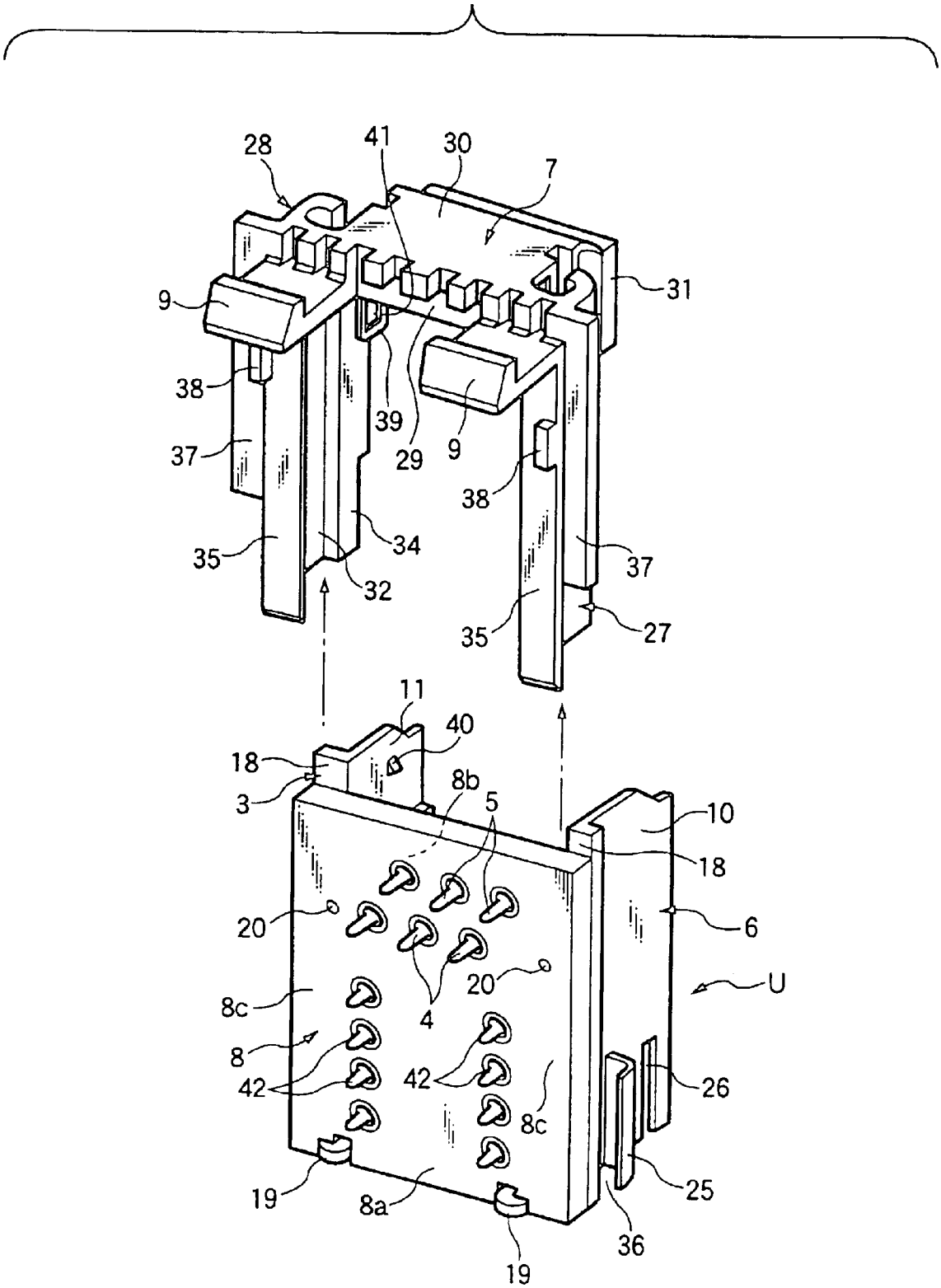
FIG. 3 is an exploded perspective view of the plug type connector which corresponds to one process of assembling the connector.

FIG. 1 is an exploded perspective view of a plug type connector 1 and a receptacle type connector 2 which form a pair of connectors as an embodiment of the present invention. FIG. 2 is an exploded perspective view of the plug type connector 1, wherein the view is taken from the back side. FIG. 3 is an exploded perspective view of the plug type connector which corresponds to one process of assembling the connector.

Referring to FIG. 1, the plug type connector 1 is fixed to a side plate of the toner cartridge. On the other hand, the receptacle type connector 2 is fixed to a predetermined portion of the image forming apparatus body. Referring to FIG. 2, the plug type connector 1 includes: a plug housing 6 having a back face 3 which is opposed to a side plate of the toner cartridge, the plug housing 6 holding a plurality of contacts 4, 5, the profile of which is a reverse L-shape, laterally in line; a cover housing 7 combined with this plug housing 6; and a circuit board 8 held by both the housings 6, 7. Reference numeral 9 is a pair of attaching hooks protruding from an upper portion of the back face of the cover housing 7. Reference numeral 38 is a pair of positioning ribs provided in the same manner. These attaching hooks 9 and positioning ribs 38 are used when the plug type connector 1 is attached to the side plate of the toner cartridge.

Figure 6:
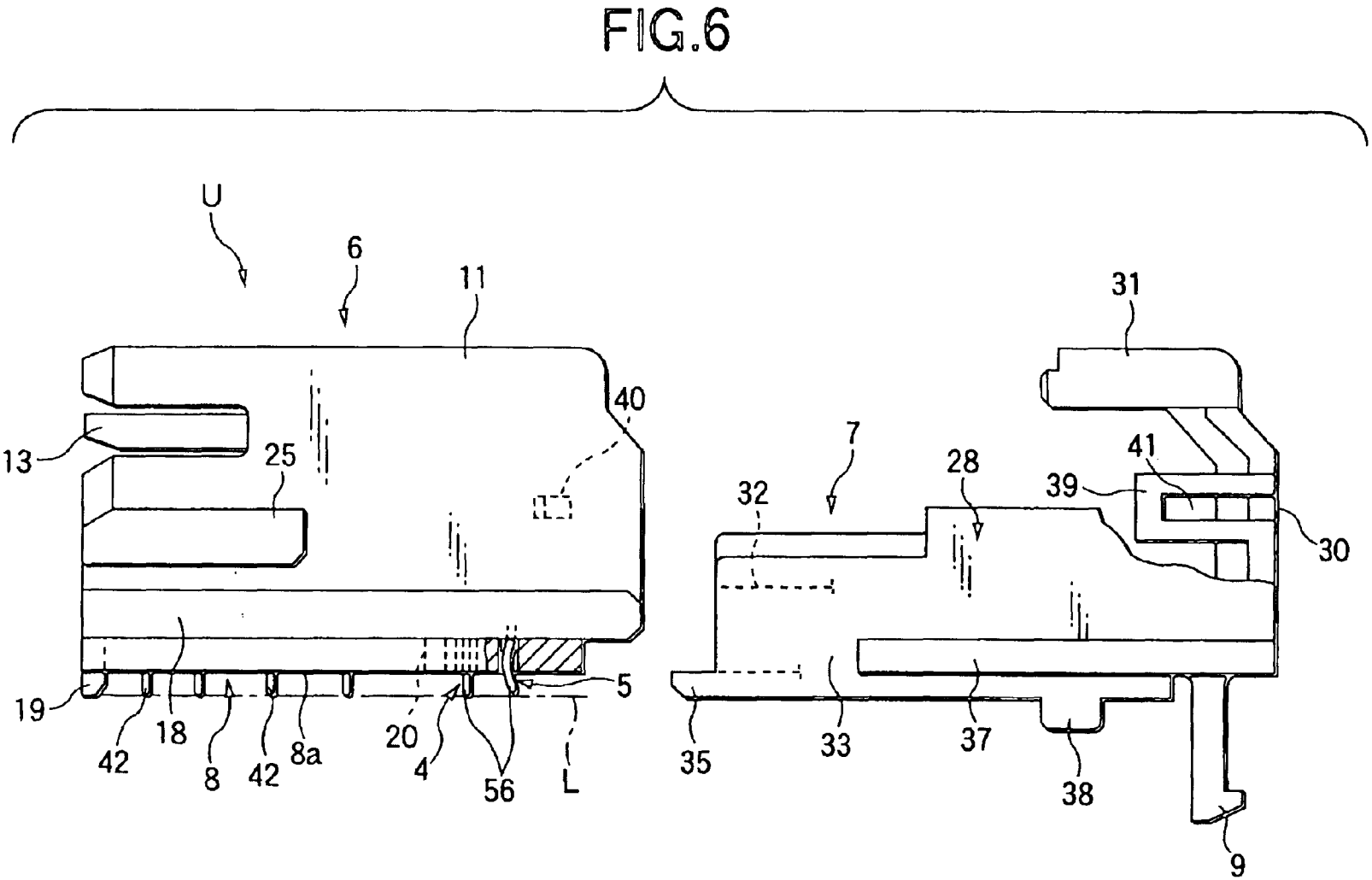
FIG. 6 is a partially cross sectional side view showing a state in which a unit and housing cover are relatively slid from each other so that they can be assembled.

The plug type connector 1 is assembled as follows. As shown in FIGS. 3 and 6, when the circuit board 8 is set along and fixed to the back face of the plug housing 6 into which the contacts 4, 5 are previously incorporated, a unit U including the plug housing 6, contacts 4, 5 and circuit board 8 can be formed as an intermediate body for manufacturing. Next, the cover housing 7 is assembled to this unit U when the cover housing 7 is relatively slid in parallel with the surface 8*a* of the circuit board 8. In this way, the cover housing 7 can be easily incorporated into the unit U by a sliding motion. Since the components are formed into a unit and the cover housing 7 can be incorporated into the unit U by the sliding motion, the assembling work can be made easy.

In the unit U, the circuit board 8 has a function of making up the wall section of the plug housing 6. Although not shown in the drawing, for example, devices such as diodes and condensers are attached onto the surface 8*a* of the circuit board 8 which is exposed outside the unit U, and an IC package is attached onto the reverse face 8*b* of the circuit board 8. Reference numeral 42 is a lead of an IC chip.

Referring to FIG. 2, the plug housing 6 includes: a pair of side plates 10, 11; a front plate 12 for connecting the lower half sections of these side plates 10, 11; a contact holding wall 13 extending in parallel with the front plate 12, the contact holding wall 13 connecting the right and left side plates 10, 11 with each other; an upper plate 14 extending from the upper end of the contact holding wall 13 to the back face 3 side, the upper plate 14 connecting the right and left side plates 10, 11 with each other; and a bottom plate 15 for connecting the rear lower end portions of the right and left side plates 10, 11 with each other.

Figure 4A:
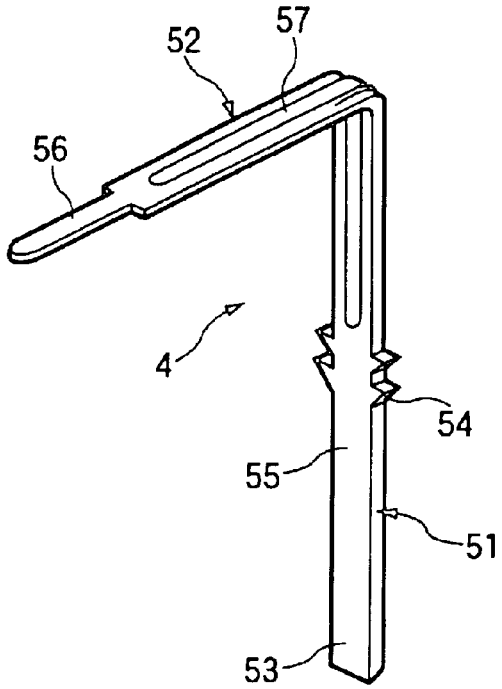
FIGS. 4(*a*) and 4(*b*) are perspective views respectively showing a contact.
Figure 4B:
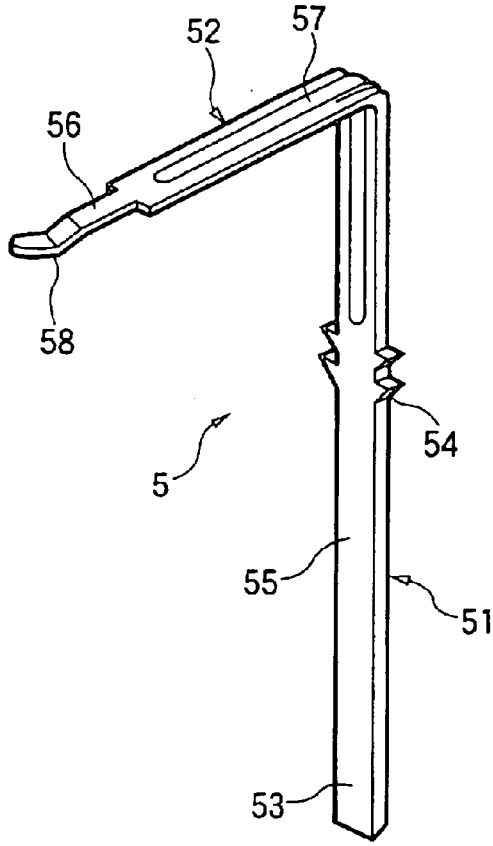

The contact holding grooves 16, 17 for holding the contacts 4, 5 laterally in line are respectively formed on the contact holding wall 13 and the upper plate 14. Referring to FIGS. 4(*a*) and 4(*b*), each contact 4, 5 includes: a first portion 51 extending downward along the contact holding groove 16 on the contact holding wall 13, that is, extending in parallel with the surface 8*a* of the circuit board 8; and a second portion 52 extending along the holding groove 17 on the upper plate 14, that is, extending in a direction perpendicular to the surface 8*a* of the circuit board 8.

The first portion 51 includes: a contact section 53 coming into contact with a corresponding contact of the receptacle type connector 2; and a fixing section 55 having a press-fit protrusion 54 to be press-fitted into the contact holding groove 16. The second portion 52 includes a narrow lead section 56. Length of the first portion 51 of the contact 5 on the upper side is longer than that of the contact 4. Reference numeral 57 is a reinforcement rib provided in both the first 51 and the second portion 52.

The lead section 56 of the contact 5 on the upper side is provided with a kink section 58 which is bent into an angle shape corresponding to an inserting portion inserted into the insertion hole 23 on the circuit board 8. When the kink section 56 is elastically engaged in the insertion hole 23, the circuit board 8 can be positively held. If some of the plurality of contacts 5 are provided with a kink section 58 which is reversely bent, the holding force for holding the circuit board 8 can be enhanced. Therefore, this structure is preferable.

At the rear edge of each side plate 10, 11, there is provided a flange-shaped edge section 18 which is directed outward. On the bottom plate 15, there are provided first holding members 19 composed of a pair of hooks protruding backward. On the right and left of the base end section of each first holding member 19, there are provided notches. Due to the above structure, length of the first holding member 19 can be extended and a quantity of elastic deformation of the first holding member 19 can be ensured without protruding the forward end section of the first holding member 19 from the back face 3 too long.

On the back face 3 of the plug housing 6, the second holding members 20, for example, which are composed of a pair of pillar-shaped protrusions, are protruded from the connecting portions in which the upper plate 14 and the side plates 10, 11 are connected with each other.

On the other hand, in the lower edge section of the circuit board 8, there are provided a pair of insertion holes 21, which are open downward, into which the first holding members 19 composed of a pair of hooks are inserted.

In the upper section of the circuit board 8, there are provided a pair of insertion holes 22 into which the second holding members 20 composed of a pair of pillar-shaped protrusions are inserted. On the circuit board 8, there are provided insertion holes 23 into which the lead end sections of the contacts 4, 5 are inserted, and also there are provided insertion holes 24 into which the end sections of the leads 42 of the IC package are inserted.

Figure 5:
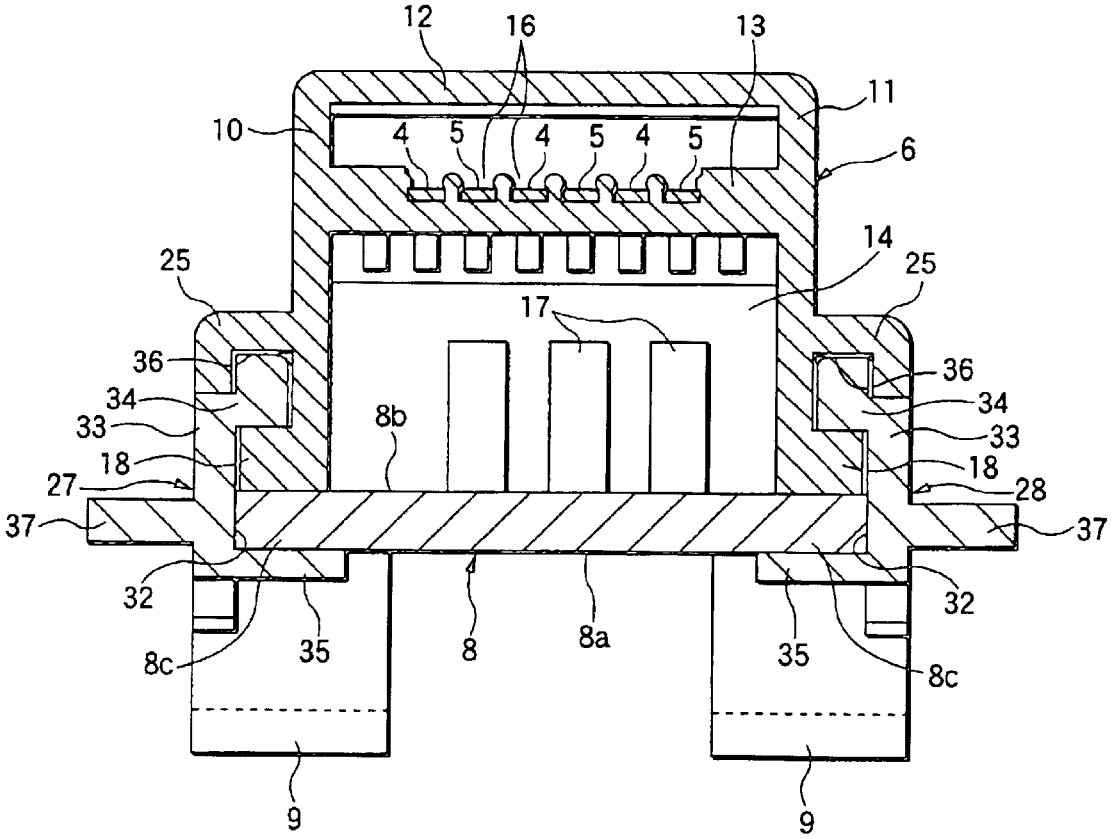
FIG. 5 is a lateral cross-sectional view showing a plug type connector.

In the lower end section of each side plate 10, 11, there is provided an angle-shaped rib 25 extending in parallel with the edge section 18. As shown in FIG. 5, between the rib 25 and the edge section 18, there is provided a guide groove 36 in which the front edge section 34 of the side member 27, 28 is slid being guided as described later. Reference numeral 26 is an open groove for forming a gap by which the lower portion of the side edge of the contact holding wall 13 and the corresponding side plate 10, 11 are separated.

In the unit U in which the circuit board 8 is attached to the back face 3 of the plug housing 6, as shown in FIG. 5, an opening portion, the cross-section of which is a C-shape, which is formed by the pair of side plates 10, 11 of the plug housing 6 and the contact holding wall 13, is covered with the circuit board 8. As a result, the pair of side plates 9, 10 of the plug housing 6, the contact holding wall 13 and the circuit board 8 form a closed cross-section and exhibit a block structure. Therefore, it as possible to ensure a high mechanical strength. On the other hand, the front plate 12, both side plates 10, 11 and contact holding wall 13 also exhibit a block structure. Therefore, the structural strength can be enhanced.

In the unit U in which the circuit board 8 is set along and fixed to the back face 3 of the plug housing 6, as shown in FIG. 6, the forward end of the first holding member 19, the lead sections 56 of the contacts 4, 5 penetrating the circuit board 8 and the exposed ends of the leads 42 of the IC chip are set on the substantially same face on line L. They are located at the most backward position in the unit U. That is, the unit U has no protruding section which protrudes backward with respect to line L. Due to the above structure, it is possible to conduct an automatic mounting in which the lead sections 55 of the contacts 4, 5 and the leads 42 of the IC chip are soldered to the circuit board 8 in a dip tank.

Elements, which are necessary to protrude backward with respect to line L, for attaching the plug type connector 1 onto the side plate of the toner cartridge, for example, the attaching hooks 9 and the positioning ribs 38 are provided in the cover housing 7.

Referring to FIGS. 2 and 3, the cover housing 7 includes: a pair of side members 27, 28 extending upward and downward forming a groove-shape which is open inward; a connecting section 29, which extends in the lateral direction, for connecting the upper portions of both the side members 27, 28 with each other; an upper plate 30 extending from the connecting section 29; and a front plate 31 extending downward from the front end of the upper plate 30. The pair of attaching hooks 9 described before are protruded from the connecting section 29.

Referring to FIGS. 2, 3 and 5, each side member 27, 28, the profile of which is formed into a groove-shape, has a guide groove 32 for guiding the sliding motions of the corresponding edge section 8*c* of the circuit board 8 and the corresponding edge section 18 of each side plate 10, 11 of the plug housing 6. As described above, since the edge section 8*c* of the circuit board 8 and the edge section 18 of the plug housing 6 get into the guide groove 32 of the cover housing 7, both the housings 6, 7 can be strongly combined with each other, and further both the housings 6, 7 can be tightly combined with each other, so that toner can be prevented from intruding into the housings. Joint portions of both the housings 6, 7 are positively joined to each other basically with a so-called ship-lap or rabbet joint. Therefore, the mechanical strength of the joint portion is high, and the joint portion is tightly closed, so that toner can be prevented from intruding into the housings.

Each side member 27, 28 is formed into a groove-shape by the side plate 33, front edge section 34 and rear edge section 35. The front edger section 34 is formed into an angle-shape and slid and guided in the guide groove 36 formed between the rib 25 and the edge section 18 of the plug housing 6. Reference numeral 37 is a reinforcement rib extending downward from the connecting section 29 formed outward from the side plate 33 of each side member 27, 28.

Figure 7A:
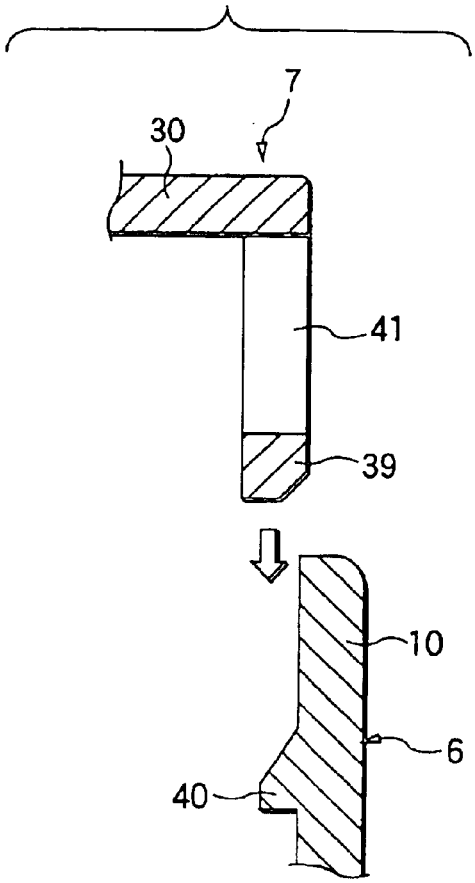
FIGS. 7(*a*) and 7(*b*) are cross-sectional views of primary portions of both housings which successively show processes in which a combination state of a plug housing with a cover housing is locked.
Figure 7B:
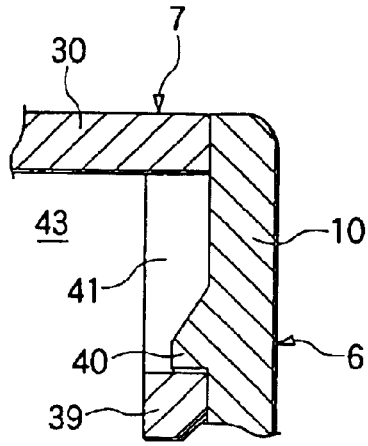

Referring to FIGS. 2, 3 and 6, there are provided cantilever-shaped extending pieces 39 which extend downward from the right and left side edges of the upper plate 30. Each extending piece 39 has an engaging hole 41 engaged with an engaging protrusion 40 formed on the inner face of each side plate 10, 11 of the plug housing 6. As shown in FIG. 7(*a*), when both the housings 6, 7 are slid and combined with each other, the extending pieces 39 are guided along the inner face of the corresponding side plate (or 11). As shown in FIG. 7(*b*), when both the housings 6, 7 are combined with each other, the engaging protrusion 40 is engaged with the engaging hole 41, so that the combination state of both the housings 6, 7 is locked. That is, these engaging section 40 and the engaging hole 41 compose a lock section for locking the combination state of both the housings 6, 7 in the space 43 surrounded by the plug housing 6 and the cover housing 7.

As described above, what is called an inner lock structure is realized. Therefore, after both the housings 6, 7 have been once combined with each other, even if the connectors are given a shock, they are not disconnected from each other, and further there is no possibility that a user carelessly take apart the connectors. However, in order to recycle the connectors, the degree of locking may be determined so that the connectors can be easily taken apart when necessary.

As explained above, according to the present embodiment, the housings 6, 7 of two piece structure are used. Therefore, the degree of freedom of designing can be increased when the circuit board 8 is laid out in the housing.

When the number of times of image formation and the information about a quantity of residual toner are stored in the memory mounted on the circuit board 8, even if the cartridge of toner is detached before the life of the cartridge is fulfilled and the cartridge of toner is attached again, it is possible to accurately grasp the life of the cartridge of toner and the quantity of residual toner.

Further, when ID number is stored in the memory, it is possible to distinguish an imitation article from a true article. Therefore, it is possible to avoid using the imitation article.

It should be noted that the present invention is not limited to the above specific embodiment. For example, the cartridge of toner to which the present connectors are attached may be a single body. Alternatively, the cartridge of toner may be composed of a unit in which other components of the image forming apparatus such as a developing device, photoreceptor and charger are integrated.

Further, devices except for IC chips may be attached onto the reverse face 8*b* of the circuit board 8. Variations may be mad by one skilled in the art without departing from the spirit and scope of the present invention.

What is claimed is:

1. A connector for a side plate of a cartridge which removably attaches to an apparatus and contains electronic parts, comprising:

a plug housing including a back face opposing to the side plate of the cartridge of the electronic parts and holding at least one contact;

a cover housing combined with the plug housing; and a circuit board held by the plug housing, the cover housing and the at least one contact, the circuit board electrically connected to the apparatus via the at least one contact;

wherein the cover housing includes guide grooves configured to guide the plug housing in a sliding motion, and edge sections of the circuit board and edge sections of the plug housing both which are slideable in the guide grooves, and wherein said circuit board includes a memory, and the memory is configured to communicate with the apparatus to obtain updated information related to the cartridge.

2. The connector for a cartridge of electronic parts according to claim 1, wherein the plug housing and the cover housing are combined with each other and are slideable relative to each other in a direction parallel with a surface of the circuit board.

3. The connector for a cartridge of electronic parts according to claim 1, wherein the circuit board is connected with the plug housing such that the circuit board covers an open portion of the plug housing thereby forming a closed cross-section with the plug housing.

4. The connector for a cartridge of electronic parts according to claim 1, wherein a lock section is configured to lock both the plug housing and the cover housing, which are combined with each other, and is arranged in a space surrounded by the plug housing and the cover housing.

5. The connector for a cartridge of electronic parts according to claim 1, wherein the cartridge of electronic parts is a cartridge of toner.

6. The connector of claim 1, wherein the information includes at least one of an amount of image formation, residual toner quantity, and an ID number.

7. The connector of claim 1, wherein said memory is maintained during disconnection of the cartridge to the apparatus.

8. The connector for a cartridge of electronic parts according to claim 1, wherein a unit including the plug housing, the circuit board and a contact are unitarily assembled into the cover housing.

9. The connector for a cartridge of electronic parts according to claim 8, wherein a forward end of a holding member which holds the circuit board and an exposed end portion of at least one lead penetrating the circuit board terminate on substantially a same face at a rearmost portion of the connector.

10. The connector for a cartridge of electronic parts according to claim 8, wherein a forward end of a holding member which holds the circuit board and an exposed end portion of the at least one contact penetrating the circuit board are located on the back face of the plug housing.

11. The connector for a cartridge of electronic parts according to claim 10, wherein the cover housing includes a protruding section configured to attach to the cartridge of electronic parts.

12. A connector for a cartridge of electronic parts, which is a plug type connector fixed to a side plate of the cartridge of electronic parts which removably attaches to an apparatus, comprising:

a plug housing including a back face opposing to the side plate of the cartridge of electronic parts;

a cover housing combined with the plug housing; and a circuit board fixed to the back face and held by both the housing;

wherein the cover housing includes means for attaching to the side plate of the cartridge of electronic parts, and wherein said circuit board includes a memory, and the memory is configured to communicate with the apparatus to obtain undated information related to the cartridge.

13. The connector of claim 12, wherein the cartridge of electronic parts is a cartridge of toner.

14. A connector system for an image apparatus, comprising:

a cartridge of electronic parts configured to removably attach to the image apparatus;

a plug housing including a back face opposing to a side plate of the cartridge of electronic parts and holding at least one contact;

a cover housing combined with the plug housing; and a circuit board held by the plug housing, the cover housing and the contact, the circuit board electrically connected to the apparatus via the contact, wherein said circuit board includes a memory, and the memory is configured to communicate with the apparatus to obtain undated information related to the cartridge.

15. The connector system of claim 14, wherein the cartridge of electronic parts is a cartridge of toner.

16. The connector system of claim 14, wherein the information includes at least one of an amount of image formation, residual toner quantity, and an ID number.

17. The connector system of claim 14, wherein said memory is maintained during disconnection of the cartridge to the apparatus.

18. A connector for a side plate of a cartridge which removably attaches to an apparatus and contains electronic parts, comprising:

a plug housing including a back face opposing to the side plate of the cartridge of the electronic parts and holding at least one contact;

a cover housing combined with the plug housing; and a circuit board held by the plug housing, the cover housing and the at least one contact, the circuit board electrically connected to the apparatus via the at least one contact;

wherein the plug housing and the cover housing are combined with each other and are slideable relative to each other in a direction parallel with a surface of the circuit board, and wherein said circuit board includes a memory, and the memory is configured to communicate with the apparatus to obtain undated information related to the cartridge.

19. A connector for a side plate of a cartridge which removably attaches to an apparatus and contains electronic parts, comprising:

a plug housing including a back face opposing to the side plate of the cartridge of the electronic parts and holding at least one contact;

a cover housing combined with the plug housing; and a circuit board held by the plug housing, the cover housing and the at least one contact, the circuit board electrically connected to the apparatus via the at least one contact;

wherein a unit including the plug housing, the circuit board and a contact are unitarily assembled into the cover housing, wherein a forward end of a holding member which holds the circuit board and an exposed end portion of a lead penetrating the circuit board are located on the back face of the plug housing, and wherein said circuit board includes a memory, and the memory is configured to communicate with the apparatus to obtain updated information related to the cartridge.

20. The connector for a cartridge of electronic parts according to claim 19, wherein the cover housing includes a protruding section configured to attach to the cartridge of electronic parts.

21. A connector for a side plate of a cartridge which removably attaches to an apparatus and contains electronic parts, comprising:

a plug housing including a back face opposing to the side plate of the cartridge of the electronic parts and holding at least one contact;

a cover housing combined with the plug housing; and a circuit board held by the plug housing, the cover housing and the at least one contact, the circuit board electrically connected to the apparatus via the at least one contact;

wherein an exposed end of a lead section of the at least one contact penetrating through insertion holes in the circuit board an exposed ends of leads of an IC chip mounted on the circuit board are substantially flush with each other.

* * * * *